United States Patent [19]

Gadberry

[11] 3,957,183

[45] May 18, 1976

[54] BACKPACK FOR BREATHING TANKS

[75] Inventor: Donald L. Gadberry, Huntington Beach, Calif.

[73] Assignee: U.S. Divers Company, Santa Ana, Calif.

[22] Filed: Mar. 14, 1974

[21] Appl. No.: 451,097

[52] U.S. Cl. ..... 224/5 W; 24/197; 224/25 A

[51] Int. Cl.[2] ..... A45F 3/00

[58] Field of Search ..... 224/5 W, 5 R, 25 A; 24/206 R, 226, 201 HE, 197, 193 D; 2/338; 214/31.2

[56] References Cited

UNITED STATES PATENTS

| | | | |
|---|---|---|---|
| 625,573 | 5/1899 | Leavitt | 294/31.2 |
| 1,220,466 | 3/1917 | Schultz | 294/31.2 |
| 1,904,230 | 4/1933 | Hildebrand | 24/206 R |
| 2,549,841 | 4/1951 | Morrow et al. | 24/197 |
| 2,675,150 | 4/1954 | Ackerman | 224/5 W |
| 2,943,775 | 7/1960 | Mack | 224/5 W |
| 3,033,431 | 5/1962 | Henderson et al. | 224/5 W |
| 3,191,828 | 6/1965 | Senne | 224/25 A |
| 3,407,452 | 10/1968 | Abert et al. | 24/197 |

*Primary Examiner*—Robert J. Spar
*Assistant Examiner*—Lawrence J. Oresky

[57] ABSTRACT

Apparatus for carrying a tank of compressed breathing gas on the back of a user having a main back plate molded portion with handle openings and webs therein, and slits for receiving shoulder straps. The shoulder straps are looped through the back plate slits and webs in a continuous manner to form a combination shoulder, chest, and waist strap interconnected by means of two quick release fittings.

The quick release fittings comprise an upper and lower buckle fitting. The upper buckle fitting has four transverse members and the lower buckle fitting is fundamentally a rectangular loop with two transverse members.

The breathing gas tank is secured to the plastic molded back plate by means of a surrounding band assembly that is secured to the plate by means of U-bolts. The band assembly can be expanded or contracted by adjustment of the U-bolts and a hooked tongue which secures the band to the plastic plate, as well as by means of an adjustable over-center latch.

9 Claims, 10 Drawing Figures

BACKPACK FOR BREATHING TANKS

BACKGROUND OF THE INVENTION

1. Field of the Invention

The field of this invention lies within the self contained breathing apparatus art. More specifically, it resides within the field of carrying a tank of breathing gas under pressure on the back of a user for facilitating general usage of self contained underwater breathing apparatus as well as usage of the breathing gas in other hostile environments.

2. The Prior Art

The prior art related to carrying breathing gas under pressure on a user's back comprises numerous devices. One of the devices incorporated utilization of a thin sheetlike material having crossover straps attached thereto which can be placed across the user's shoulders. The thin sheet-like material upon which the breathing gas tank rests, tends to be burdensome to a user and also cuts into a user's back.

Other prior art discloses the utilization of a molded backpack having a surface which supposedly conforms to a user's back. However, as can be appreciated, not every user has the same back conformation. As a consequence, such a backpack type of plate does not conform to the user's back and oftentimes is uncomfortable.

Another form of backpack assembly utilizes a series of straps which supposedly enhance the carrying of the backpack. In addition thereto, the back plate incorporates a double pair of strap in order to hold a breathing gas tank thereon. The double pair of straps have a specific conformation in order to orient the tank in a position so that it is not imbalanced with respect to a user.

Other backpacks for breathing gas purposes incorporate a resilient self supporting back plate. The resilient self supporting back plate has two wings which override a user's shoulders in order to maintain the backplate in a hanging position against a user's back. The two wings which overlie a user's shoulder are burdensome, because they are stiff and unyielding to a user's body.

A further improvement in backpacks incorporates the utilization of a plastic backpack conforming to a tank which is to be carried. However, it has been found that variously sized tanks and variously sized users cannot be accommodated to this type of backpack. Specifically, this type of backpack eliminates a snug fitting relationship of the backpack to a user's back.

In addition to all the foregoing drawbacks with regard to the conformation of a backpack to a user, it has also been found that such backpacks are not capable of being jettisoned. In other words, when a diver or one in a hostile environment must escape, it is oftentimes necessary to jettison the self contained breathing apparatus. Specifically, when a diver is down for a certain length of time and must reach the surface, he oftentimes finds it necessary to jettison his entire backpack and self contained underwater breathing apparatus.

The prior art does not provide for a quick release of the self contained underwater breathing apparatus. As a consequence, a diver must normally unstrap the waistband, as well as the shoulder straps in order to release his selfcontained underwater breathing apparatus.

Additionally, it has been found that the prior art backpacks do not accommodate variously sized pressure tanks that a user of self contained breathing apparatus utilizes. Furthermore, when the entire assembly of the self contained breathing apparatus, the backpack, and the tank utilized therewith are carried, it is cumbersome.

This invention overcomes the prior art deficiencies by providing a readily conformed backpack assembly which adapts itself to both the user and the variously sized tanks to be utilized therewith. The invention also has a number of handles or carrying openings which can serve the user effectively for moving the tank with the backpack assembly attached thereto.

More importantly, the entire strap or harness assembly utilizes a quick release fixture. This enables the user to jettison the backpack assembly in a quick and facile manner by merely pushing upwardly on the protruding portion on the buckle, in the case of the shoulder straps, and pulling outwardly on the protruding portion of the buckle, in the case of the waist strap. Thus, when the backpack is jettisoned, the user need merely lift up on a portion of the fixture and the entire assembly falls free from the user's shoulders. This enables the user to easily jettison the backpack and the tank without any substantial risk, and in an easy and facile manner.

SUMMARY OF THE INVENTION

In summation, this invention comprises a novel backpack having a new improved harness release mechanism and tank securement means.

More specifically, the invention comprises A contoured plastic molded back plate having hand grips therein. The back plate also has slits and webs for purposes of receiving the harness. The harness is adjustable with fixtures which also provide a quick release mechanism. The fixtures comprise an upper and lower buckle respectively having four and two transverse members through which the harness straps are looped.

A high pressure breathing gas tank is secured to a contoured portion of the backpack plate by a band assembly. The band assembly can be adjustably moved with respect to openings within the band of the band assembly and secured by an overcenter latching tongue which engages the openings within the band. The entire backpack with the straps and band assembly, is carried by the handles and forms a compact and easily used apparatus for carrying a tank of breathing gas under pressure.

DESCRIPTION OF THE PREFERRED EMBODIMENTS

General Backplate Configuration

Figures 1, 2, 3, 7, 8:
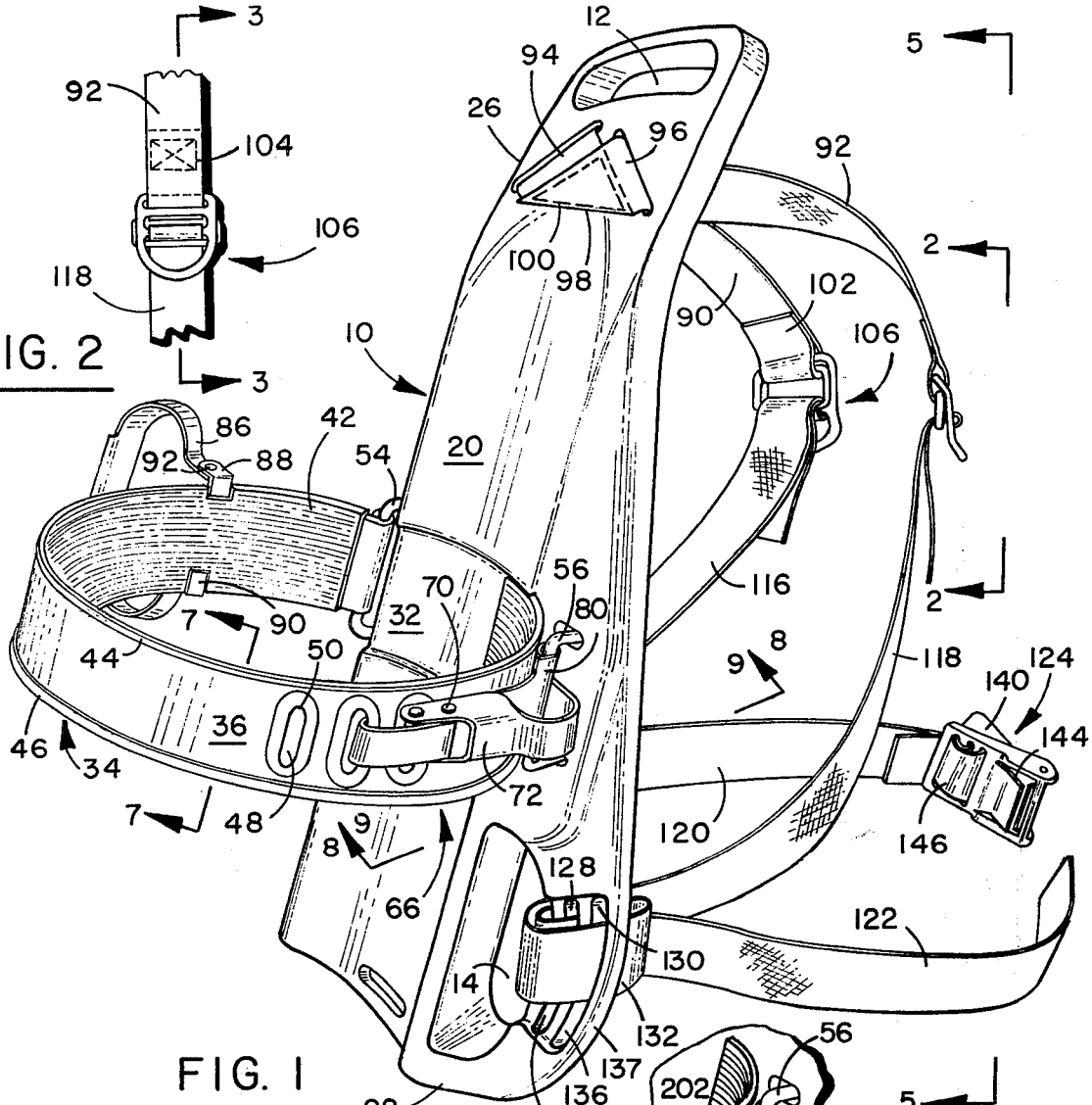
FIG. 1 shows a perspective view of the entire backpack with the harnesses prepared to receive a user.
FIG. 2 shows a plan view of the quick release fixtures used to secure the harness, along lines 2—2 of FIG. 1.
FIG. 3 shows a sectional view delineating the relationship of the straps to the securement fixture along lines 3—3 of FIG. 2.
FIG. 7 shows a sectional view of the band along lines 7—7 of FIG. 1.
FIG. 8 shows a view detailing an alternative embodiment for securing the band to the backpack plate.
Figure 5:
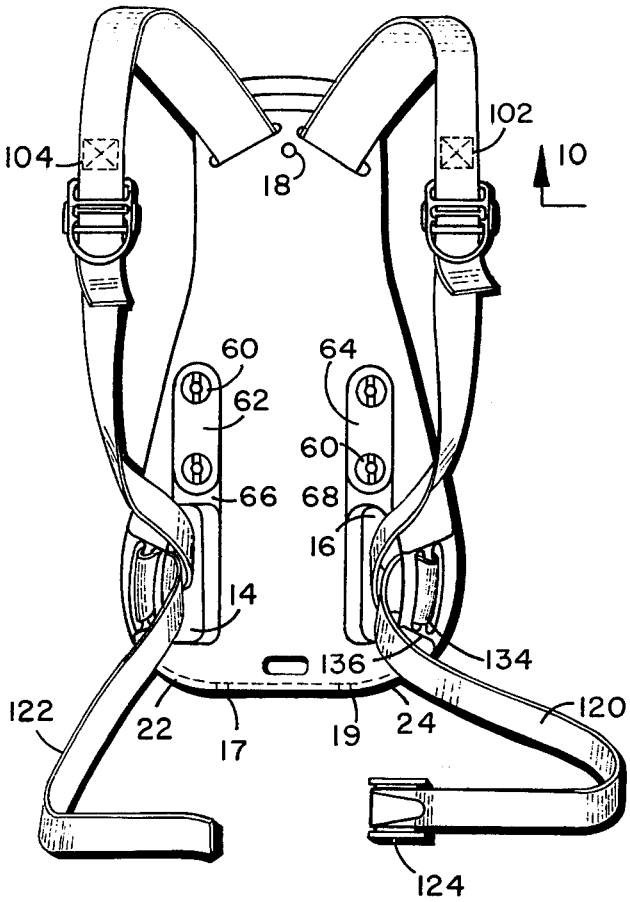
FIG. 5 shows an elevation view of the backpack in the direction of lines 5—5 of FIG. 1 at the surface, wherein the backpack is adjacent to a user's back.

Looking more particularly at FIG. 1, the entire backpack apparatus assembly is shown. The backpack apparatus has a plastic molded back plate 10. The plastic molded back plate 10 can be molded or formed of any material. The particular embodiment of the back plate 10 in this instance is formed from a blow molded plastic and has a space therein. Thus, the entire backpack plate 10 is of a double walled configuration having a front and back wall with a void therebetween.

The back plate 10 is provided with openings 12 at the top, and 14 and 16 at the lower lateral portions. The openings 12, 14 and 16 facilitate carrying the entire backpack by providing hand grips through which a user's hand can reach and grasp. In this manner, the entire apparatus when it is utilized with a tank of breathing gas, can be moved in a facile manner.

The backpack plate, being hollow, sometimes takes on water. As a consequence, an opening 18 is provided at the top for a drainage vent and also two openings 17 and 19 in the base to allow drainage from the void within the backpack.

The backpack plate is configured with a curved portion or surface 20 where it receives a tank of breathing gas that is not shown. Additionally thereto, the backpack has a curved configuration with two wings 22 and 24 which curve to confrom to the general physiological features of a user's back. In addition to the foregoing curve, an upper portion or neck 26 near the hand grip opening 12 is configured to bend forwardly in the direction of a user's back neck area, so that the entire back plate 10 will conform to the physiological conformation of a user. The curve of the neck 26 also provides clearance so that it will not hit a regulator which is mounted on the top of a tank held by the backpack.

Band Assembly

The plastic molded back plate 10 has a depression below the surface of the generally rounded concave portion 20. The depression 32 provides for the extension of a band assembly 34. The band assembly 34 is firstly comprised of a metal band 36 with a plastic or elastomeric liner material 40 having serrations or ribs 42 thereon. The plastic or elastomeric material is turned over at edges 44 and 46 to provide a gripping of the metal band material 36. The band 36 seats within the depression 32 when the tank is resting against the band and is clamped thereby.

The metal band material 36 is coined out at openings 48. The coined out portion eliminates ripping the metal band by tension put thereon, as well as holding the respective ends of the latches to be described, away from a tank surface attached to the pack to prevent the possibility of damage to its surface finish.

The band assembly 34 in FIG. 1 is shown held by two U-bolts 54 and 56. The U-bolts 54 and 56 are threaded to receive a series of wing nuts 60. The wing nuts 60 can be utilized with two elongated oval plates 62 and 64 to hold the U-bolts 54 and 56 in two respective depressions 66 and 68 that have been molded into the back of the plate 10. The plates 62 and 64 prevent the U-bolts 54 and 56 from pulling through the plate 10 by distributing the load caused by clamping the tank, over a wider surface area. Thus, the plates 62 and 64 are counter sunk with their respective wing nuts 60 into the interior cross section area of the back plate 10. This eliminates any protrusion of the wing nuts 60 against the back of a user when the back plate is lying against a user's back.

The U-bolts 54 and 56 respectively receive round cylindrical end portions of the band 36. The band 36 terminates at U-bolt 54 in a rounded cylindrical turned over portion. It is fundamentally rolled back on itself to provide a cylindrical opening for journalling the U-bolt 54.

The other end of the band 36 serves the function of adjusting the circumference of the band to accommodate variously sized tanks therein. This is accomplished by means of a snap buckle or latch assembly 66 generally shown in FIGS. 9 and 10. The latch assembly 66 comprises a hooked tongue 68 which hooks into the coined out openings 48 of the band 36. The tongue, or hook 68 is pivotally connected to a pin 70. The pin 70 is transversely riveted through a lever handle 72, which is turned under at point 74 at its end. The lever handle 72 is pivotally connected to a pin 76 attached to a securement member 78 having a turned over portion 80 that serves to journal the U-bolt 56.

The hook 68 provides for tension being placed on the band 36 so that it can snugly secure a tank on the concave portion 20 of the back plate 10. When the handle 72 is pulled outwardly, it releases tension on the hook 68 so that it can be released from the coined out opening 48.

The latch 66 effectively is an over center type of latch that applies tension to the tongue 68 to hold a tank in place. The over center relationship is maintained when the end portion 74 of the handle 72 is frictionally engaged on the rounded rolled over cylindrical portion 80 of the securement member 78. This frictional engagement of the end portion 74 provides a safety feature due to its snap-over fit requiring a concentrated effort to pull the handle 72 open. Thus, the latch handle 72 cannot be easily pulled open by accident, causing a tank held in the band 36 to fall out.

The band 36 is provided with a handle 86 having two attachment members 88 and 90 that are affixed to the band 36. The attachment members 88 and 90 pivotally connect the handle by a pin 92 at each member so that one can freely pick up the entire band assembly 36 with the back plate 10 attached thereto. In this manner, the entire assembly can pivot on the pin 92 and be easily carried at the most desirable pivotal relationship thereto.

Harness Arrangement

Looking more particularly at the harness arrangement, a pair of shoulder straps 90 and 92 are shown formed as a continuous strap through slit type openings 94 and 96 which are angled to place the straps in a physiologically compatible position within the plastic molded back plate 10. The openings 94 and 96 receive a continuous strap 90 and 92 which is formed as a continuously webbed strap and folded over into a triangular configuration 98. The triangular folded over configuration 98 is stitched together with stitching 100 for purposes of providing a flat securement of the straps 90 and 92 to the back plate 10. The stitch configuration also provides an enlarged area which will not be pulled through the openings 94 and 96.

The shoulder straps 90 and 92 are turned or looped over at their ends and stitched down by stitching 102 and 104. The stitching serves to secure a securement fixture 106 which is comprised of an upper loop or buckle fixture 108 and a lower loop or buckle fixture 110.

The upper and lower loops or buckle fixtures are secured together by the stitched over webbing 102 and 104. In other words, the strap 92 is secured by the stitching 102 in a looped over manner providing a loop 112 which secures the respective buckle fixtures 108 and 110 forming the entire securement fixture 106.

The shoulder straps are secured to the lower straps or chest straps respectively 116 and 118 by the securement fixture 106. The chest straps 116 and 118 form a continuous harness to be utilized in its continuous conformation as a left and right hand waist strap respectively 120 and 122. The waist strap 120 has a buckle 124 which serves to receive the terminal end of the waist strap portion 122.

The waist straps and chest straps in their continuum are looped through the back plate 10 which comprises a pair of openings 128 and 130 that receive a loop 132 of the waist and chest straps. The openings 128 and 130 are formed between the ribs 134, 136 and 137 which are utilized for wrapping the loop 132 therearound.

Thus, the chest and waist straps respectively 116, 118, 120 and 122 are a continuum and are merely looped through the respective openings 128 and 130 and the ribs 134, 136 and 137.

The buckle 124 is formed with a pivotal handle 140 having a cleating member not shown. The pivotal handle 140 releases the cleating member when it is pulled upwardly or outwardly from the buckle 124 to allow the terminal end of the waist strap 122 to pass therethrough in an unobstructed manner. Thus, when it is not being pulled upwardly, it compresses the terminal end of the waist strap 122 against the cleating member which secures the webbing therein.

The buckle 124 has openings 144 into which the terminal end passes. A looped over portion of the waist strap 146 passes through the other end of the buckle 124 in order to join the waist straps 120 and 122 together by means of the buckle 124.

Figure 6:
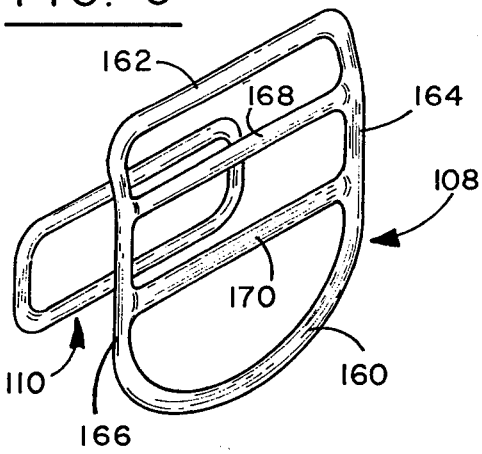
FIG. 6 shows a view of the elements of the strap securement fixture without the straps wound therethrough.
Figure 4:
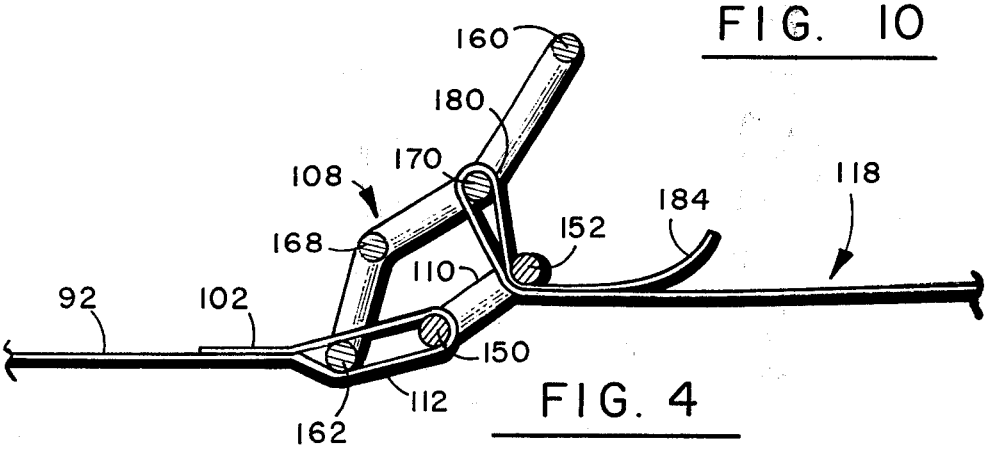
FIG. 4 shows a view of the securement fixture shown in the foregoing figures wherein it has been opened in order to release the pressure on the straps so that the backpack can be jettisoned.

Looking more particularly at FIGS. 3, 4 and 6, the lower loop or buckle fixture 110 is shown with the upper loop or buckle fixture 108 connected therethrough by the strap loop 112. The lower buckle fixture 110 has inside and outside transverse members 150 and 152 respectively that serve the function of overlying the strap 118 and passing through the loop 112. In effect, the lower buckle fixture 110 is a reactangular loop wherein transverse members 150 and 152 form two parallel sides of the rectangle.

The top loop or buckle fixture member 108 is comprised of a forward D-shaped handle element 160 and a tranverse member 162 which is secured within the loop strap 112. The inner transverse member 162 and the forward D-shaped portion 160 forms a forward and rear portion of a handle having generally parallel sides 164 and 166 with two intermediate transverse members 168 and 170 respectively referred to as a rearward and forward intermediate member.

The transverse members 162 and 170 are such that they serve to interconnect and bind the shoulder and chest straps together. The forward intermediate transverse member 170 serves the function of holding the strap loop 180 formed around it. In effect, the chest strap 118 is looped around the forward intermediate member 170 and over the transverse member 152 of the lower loop. When the strap end 184 is pulled, the chest and shoulder harness is put in tension, which causes transverse member 152 to pull up tightly against strap 118, resulting in loop 180 placed in a binding relationship tightly between transverse members 152 and 170.

When the shoulder straps 90 and 92 are loaded under tension, they serve the function of placing the respective shoulder straps and chest straps in tension and are interconnected by the securement member 106.

In the condition of tension, the transverse members 170 and 152 tend to place a bite on the loop 180 so that the terminal end 184 of the strap 118 does not slip around the forward transverse member 170.

When the D-handle portion 160 is lifted upwardly, it allows a release of the terminal end 184 by eliminating the bite placed on the loop 180 so that it is allowed to slip through the looped configuration that it is in.

Alternative Band Assembly Means

Looking more particularly at FIG. 8, the U-bolt 56 is shown attached to the back plate 10 with the coined out openings 48 shown.

The band 36 is secured by means of an alternative member 200 having a curved end portion 202 which is used to secure the member 200 within the openings 48. At the other end of the member 200, a transverse portion thereof is rolled over to form a cylinder 206 which wraps around and journals the transverse portion of the U-bolt 56. In this manner, wing nuts 60 attached to the U-bolt 56 can tighten the curved or hooked portion into the opening 48 so that the strap 36 is secured tightly around a breathing gas tank.

Figure 9:
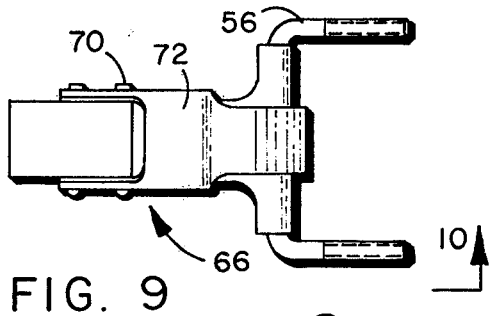
FIG. 9 shows a view of the overcenter latching means as it actually appears along lines 9—9 of FIG. 1; and, FIG. 10 shows a side elevation view of the latching means in the direction of lines 10—10 of FIG. 9.
Figure 10:
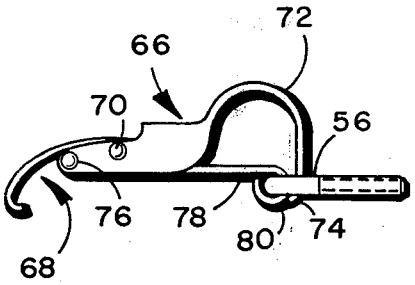

The foregoing alternative embodiment does not provide the flexibility of the overcenter operation of the latch handle 72 generally shown in FIGS. 9 and 10. However, it does provide an effective means for securing the strap 36 with a degree of adjustment thereof with respect to differently sized breathing gas tanks.

Operation of the Invention

In operation, a cylinder of breathing gas is placed within the band 36 so that it lies snugly aganist the concavity 20 of the back plate 10. The band 36 is then adjustably oriented with respect to the position that the catch or latch 66 is with respect to the openings 48. In other words, when the cylindrical tank has a larger circumference than the band, the handle 72 is released and the band is drawn out to a greater circumference. The handle 72 is then returned to its position for securely tightening the tank therein. The ribbed portion 42 of the elastomeric liner 40 tightly grips the tank to prevent slippage of the tank due to its sometimes smooth surface. Furthermore, it avoids the problem of having substantial abrasion or corrosion against the surface of the tank by providing an elastomeric or plastic interface.

When the tank is positioned and resting tightly within the concavity 20 of the back plate, the entire assembly can be placed over a diver's shoulders. Specifically, the shoulder straps 90 and 92 are placed over the shoulders with the chest straps 116 and 118 over the chest. The buckle 124 can then secure the waist straps 120 and 122 therein, so that the entire assembly is in tightened position and in conformation to a diver's body.

The terminal end 184 of the straps 116 and 118 can be pulled downwardly in order to tighten the relationship of the respective chest and shoulder straps over a diver's body. When they are pulled down, they tend to cause a snug relationship to the entire backpack on a diver's shoulders.

The relationship of the loops or buckle fixtures 108 and 110 in this particular conformation allow for a securement of the straps 90, 92, 116 and 118 so that they do not pull apart. Afterwards, the entire chest strap and shoulder strap conformation is completely secured and will not pull apart until the D-portion 160 of the upper loop or buckle fixture 108 is lifted upwardly or outwardly.

Looking more particularly at FIGS. 3 and 4, it is seen in FIG. 3 where the strap 118 is in tension and is held around the forward transverse intermediate member 170. When the D-portion 160 of the upper ring is lifted, it tends to relieve the loop 180 so that it can pass therearound so that the terminal end will pass out from the secured relationship. In this manner, the entire backpack can be jettisoned and left in situ. This, of course, is highly important when a diver wishes to extricate himself from a position or swim to the surface.

It should be understood that different embodiments and combinations can be utilized in the foregoing combination as they relate to the straps, buckle arrangement, and the back plate, as well as the band assembly. As a consequence, this invention is only to be read in light of the scope and spirit of the following claims.

I claim:

1. Apparatus for carrying a tank of breathing gas on the back of a user comprising:

a back plate having a conformation suitable for receipt of a tank of breathing gas thereon;

a band assembly which has an adjustable linkage therewith for securely affixing the breathing gas tank to the back plate;

a harness comprising shoulder straps and chest straps secured to the back plate and connected by a securement fixture comprising overlying and underlying loops, wherein said upper loop is formed of four transverse members extending across two spaced axial members and one of said transverse members forms a lifting handle that does not form a bight with any portion of the straps, said lower loop being a substantially rectangularly shaped loop, and wherein said shoulder strap is looped around both of said loops and fastened for securement thereof, and said chest strap is looped over a transverse member of said upper loop and under and through said lower loop of said securement fixture for securing it thereto.

2. The apparatus as claimed in claim 1 wherein:

said shoulder strap is fixedly looped over the end transverse portions of the upper and lower loops and is passed under and intermediate transverse member of said upper loop prior to passing around and under the transverse portion of said lower loop.

3. The apparatus as claimed in claim 2 wherein:

said chest strap has a leading end forming a loop within said lower loop and is completely looped over an intermediate transverse member of said upper loop; and, said lifting handle overlies said chest strap.

4. The apparatus as claimed in claim 3 wherein:

said upper and lower loops are formed to hold the chest strap and shoulder strap in tightened securement when the chest straps are passed therethrough and the two are respectively placed in tension and joined by said securement.

5. The apparatus as claimed in claim 4 wherein:

said securement is released by lifting up the lifting handle from over the chest straps.

6. Apparatus for carrying a tank of breathing gas on the back of a user comprising:

a back plate having a conformation suitable for receipt of a tank of breathing gas thereon;

a harness comprising shoulder straps and chest straps secured to the back plate and connected by a securement fixture comprising overlying and underlying loops wherein one of said loops is formed of at least three transverse members extending between two spaced axial members and said second loop has two transverse members, one of which is connected to a transverse member of said first loop by the shoulder strap interconnecting the two members;

an assembly for affixing the tank to the back plate comprising a band having a loop at a terminal end and a U-bolt having a transverse end passing through the loop and secured at its ends to said back plate, wherein a plurality of openings within the metal band are provided therein and a second U-bolt is secured to the back plate with means adapted to connect said band opening to said second U-bolt for adjustably changing the circumference of said band with respect to the position of said connecting means as placed with respect to the openings of said band, and further comprising a resilient material placed into the interior portion of said band where it interfaces with a pressurized tank of gas being carried.

7. The apparatus as claimed in claim 6 wherein said connecting member comprises:

a securement member having a rounded cylindrical portion through which said second U-bolt transverse member passes;

a handle pivotally connected to said securement member; and, a tongue pivotally connected to said handle having a hook at the terminal end thereof for receipt within the openings of said band.

8. The apparatus as claimed in claim 7 wherein:

said handle is pivotally mounted by a pin through said securement member; and, said handle has an angular projection at the end thereof which seats over the rounded cylindrical portion of said securement member.

9. The apparatus as claimed in claim 6 further comprising:

a carrying handle pivotally mounted to said band.

* * * * *